United States Patent [19]

Fisher et al.

[11] Patent Number: 5,057,291

[45] Date of Patent: Oct. 15, 1991

[54] OXYGEN REMOVAL FROM GAS STREAMS

[75] Inventors: Edwin E. Fisher; Richard B. Brantley, both of Midland, Tex.

[73] Assignee: Vapor Compression, Inc, Midland, Tex.

[21] Appl. No.: 475,406

[22] Filed: Feb. 5, 1990

[51] Int. Cl.[5] ..... C01B 13/08; C07C 7/12

[52] U.S. Cl. ..... 423/219; 423/231; 423/576.8; 585/824; 585/868

[58] Field of Search ..... 423/219, 231, 576.8; 585/823, 824, 868

[56] References Cited

U.S. PATENT DOCUMENTS 1,960,212 5/1934 Walker ..... 423/219

4,027,002 5/1977 Powlesland et al. ..... 423/576.8

OTHER PUBLICATIONS

Gilbert E. Seil, Dry Box Purification of Gas, p. 4, American Gas Association, N.Y. (1943).

*Primary Examiner*—Michael Lewis

*Assistant Examiner*—Brian M. Bolam

*Attorney, Agent, or Firm*—James C. Fails

[57] ABSTRACT

What is disclosed is a method of oxygen removal employing at least one solid bed of oxygen removal chemical; for example, $Fe_2S_3$ on wood chips. Also disclosed are preferred embodiments in which are employed within the at least one bed a temperature sensor, a controller is connected with the temperature sensor and a gas operated control valve is connected with the controller such that the valve is operated to shut off the valve to the sales line if the temperature sensed is greater than a preset temperature; e.g. 150 degrees Fahrenheit.

6 Claims, 1 Drawing Sheet

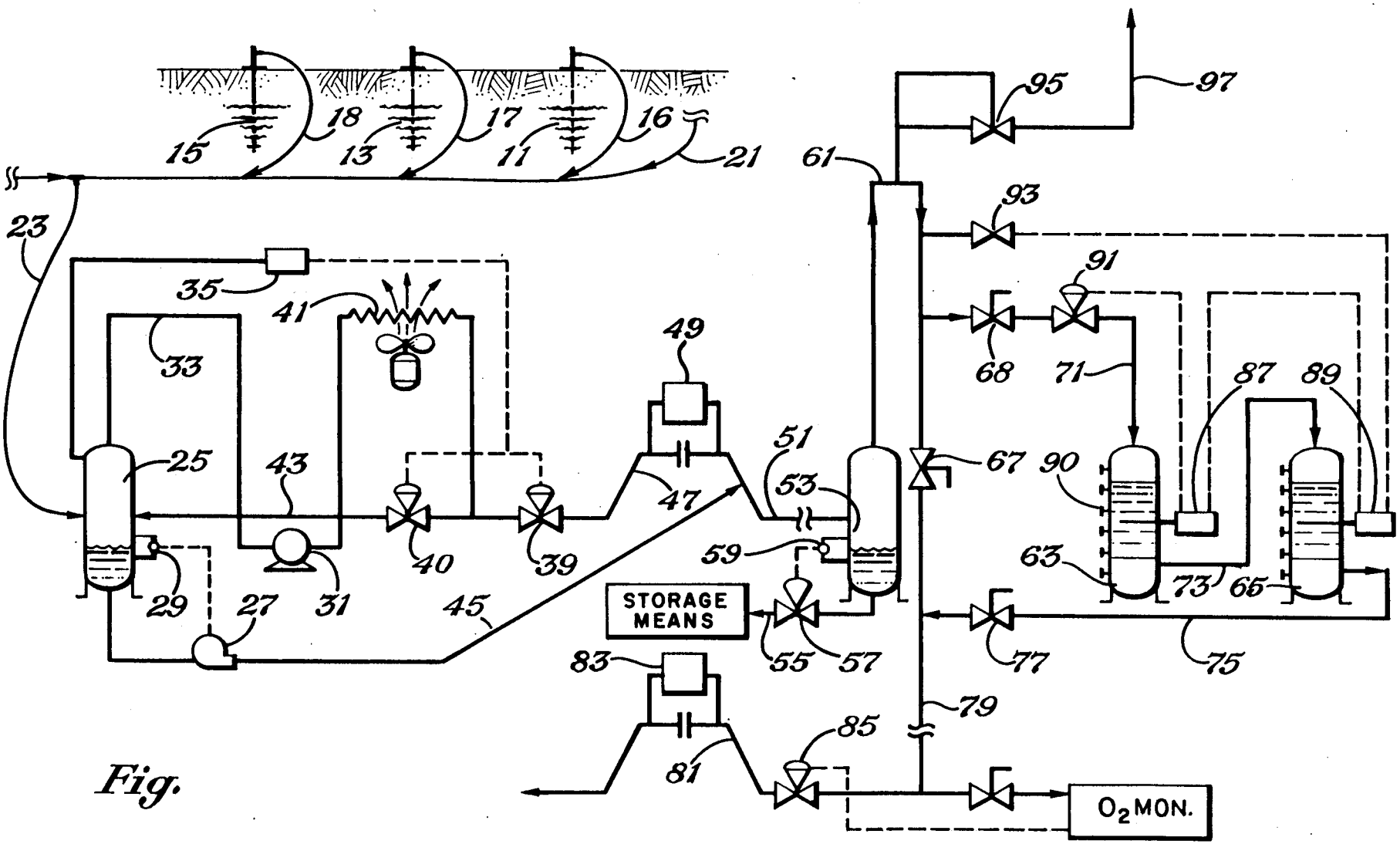
Fig.

OXYGEN REMOVAL FROM GAS STREAMS

FIELD OF THE INVENTION

This invention relates to a method of processing a gas stream. More particularly, this invention relates to a method of processing gas to remove oxygen therefrom before further use, such as selling it.

BACKGROUND OF THE INVENTION

The prior art is replete with a wide variety of methods of treating gas streams, such as natural gas streams, to remove gaseous constituents such as hydrogen sulfide, carbon dioxide and the like.

In these days of scarce energy sources, the value of low pressure natural gas streams has become great enough to make it worthwhile to have low pressure gas gathering systems and to sell the resulting collected gas streams. Particularly, in the early days of the oil field, natural gas was looked on as a dreg and was sold at anywhere from 0.05 to 0.17 dollars per thousand cubic feet (MCF). Nowadays it is possible to collect above $2.00 pr MCF of natural gas. Accordingly, many low pressure streams, some operating even down into vacuum range have been employed as a collection means for collecting the natural gas streams. Vacuum collection, however, is risky in that there is an influx of oxygen containing gas, or air, if there is a leak. Consequently, many sales streams will limit the maximum concentration of oxygen allowed in the sales stream and no good method has been achieved thus far for removing the oxygen which is not necessarily a dissolved oxygen and which is in the presence of a high concentration of other contaminants such as hydrogen sulfide.

Accordingly, it is a desirable feature of this invention to provide a method of achieving a low concentration of oxygen below a predetermined maximum concentration while remaining economically feasible and without providing insurmountable technical problems.

It is also a desirable feature of this invention to provide a method of removing from natural gas stream, containing other contaminants, oxygen without using liquid solution such as a bisulfite solution which are typically used to remove oxygen after it has been dissolved.

These features have not been provided by the prior art.

SUMMARY OF THE INVENTION

Accordingly, it is an object of this invention to provide a method which achieves at least one of the advantageous features not heretofore provided by the prior art.

It is a specific object of this invention to provide a method of achieving a sales gas in the form of natural gas having a maximum concentration of oxygen below a predetermined maximum concentration, even in the presence of other contaminants.

These and other objects will become apparent from descriptive matter hereinafter, particularly when taken in conjunction with the appended drawing.

In accordance with one aspect of this invention, there is provided a method of reducing the oxygen content of a natural gas stream below a predetermined maximum concentration comprising the step of passing the natural gas stream containing the maximum concentration of oxygen above a predetermined maximum concentration through a solid bed of oxygen removal means to remove the oxygen below the maximum concentration allowed; and, thereafter, selling a natural gas stream with its oxygen content reduced below the maximum concentration allowable.

In specific preferred embodiments, there are disclosed specific oxygen removal chemicals, such as iron sulfide on wood shavings.

BRIEF DESCRIPTION OF THE FIGURE

The FIGURE is a schematic flow diagram of one embodiment of this invention.

DESCRIPTION OF PREFERRED EMBODIMENTS

The invention may be widely useful. The invention may work on high pressure gas streams. It is, of course most advantageous where a relatively high concentration of hydrogen sulfide affords a continuous reaction and regeneration of the iron oxide to the iron sulfide for removing of oxygen. It has been employed in reducing the oxygen content of a natural gas stream below a predetermined maximum concentration and it is this environment with which the invention will be described hereinafter.

Referring to the FIGURE, a natural gas gathering system extends to a plurality of wells 11, 13, 15. For example, there may be as many as 18 to 20 wells on any given distribution system. The natural gas is then collected through low pressure lines such as lines 16, 17 and 18 and then into a main gathering line 21. The main gathering line for a low pressure system may be, for example, 2 inch polyethylene, polyvinylchloride pipe or the like. It should be impervious to the effects of sulfide. Of course, the flow lines and the gathering line will appropriate for the pressure and the material to be flowed therethrough. For example, wrought iron may be appropriate in many instances where there is low hydrogen sulfide and low water content.

In any event, the gathering line 21 will be connected, as by a suction line 23, into a separator 25. The separator 25 may be a low pressure separator with a positive liquid pump 27 operable responsive to a liquid level controller 29 on the separator.

Suitable compressor means 31 may be employed to affect compression of the low pressure gases, such as the gases in the overhead line 33, to a somewhat higher pressure. A suction vacuum controller 35 may be employed in conjunction with motor valves 39,40 to maintain the pressure as desired. A heat exchanger 41 may be employed to conduct heat away from the compressed gaseous stream.

The compressor means 31 may take any form, ranging from a conventional compressor to electric motor driven rotary sliding vane type compressor, appropriate to the material flowing through the respective elements such as the gathering line 21 and separator 25. As shown in the drawings, number 43 is a line, 31 is a compressor, 45 is a line, 27 is a line, 51 is a line and 49 is a recorder. Of course, a pressure indicator such as a gauge or recorder chart is kept on the pressure on the meter run 47 such that the flow reading will have meaning.

For example, the gathering system may come from as many 18 or more wells with a gas volume of about 40,000 cubic feet per day (MCFD), the gas may have a contaminant concentration that is exceptionally high, such as 20 percent by volume of hydrogen sulfide, with a content of oxygen maybe in the range of 50 to 500 parts per million by volume. The pressure in the gathering system may be controlled about a few inches vacuum; for example, 8 inches vacuum where inches are inches of mercury below atmospheric.

After the compressor and the liquid pump put the pressure up, it may be as high as 20 PSIG (pounds per square inch gauge) in the line 51 downstream of the meter run. Of course, other pressures can be employed as appropriate to the design of a good system.

The line 51 then leads into a higher pressure and second separator 53.

The liquids in the higher pressure separator 53 are sent to a conventional storage means such as a tank battery (not shown); e.g. via liquid products line 55, responsive to operation of motor valve 57 which is operated by the liquid level of controller 59.

The gas from the top of the separator is passed via line 61 to be processed for sale, as by being sent through the respective oxygen removal beds 63, 65. As illustrated, a valve 67 may be closed in the sales line and cause the gas to pass through the valve 68 and hence through line 71 to a first solid bed 63. The effluent from the solid bed 63 which has had the oxygen reduced therewithin, then passes through line 73 to the second solid bed 65. The effluent gas then passes through the line 75 and through valve 77 to the sales line 79. The purchasers gas sales meter run and recorder 81 and 83, respectively, then monitor the gas. An oxygen monitor, $0_2$ Mon, may be employed if desired by the purchaser to shut down the sales line 85 is a valve, 67 is a valve.

The oxygen removal equipment generates heat when oxygen is absorbed. Consequently, high temperature shut downs are employed in each of the beds. The high temperature shut downs are shown, respectively, by 87 and 89 that can effect closure of the high temperature shut down motor valve 91. Dial thermometers 90 allow monitoring of the temperature, if desired.

Ordinarily, the motor valve 91 is a spring closing type valve that is maintained in the open position by gas pressure operating on the diaphragm. The gas pressure may be supplied by a valve 93. Its pressure can be regulated very closely, if desired. In the event there is a shut down, a back pressure release valve 95 relieves gas to a flare 97. The flare line may be formed of steel or the like to prevent rupture. Otherwise, the pressure tolerances of normal plastic pipe such as polyethylene pipe is adequate to hold the pressures normally encountered.

It is noteworthy that the polyethylene pipe down stream of the beds may be weakened by high temperatures; for example, temperatures as high as 190 degrees Fahrenheit. Accordingly, the high temperature shut downs will shut down the valves in the event that there is break in one of the suction lines so that air gets into the line and then creates a high temperature that would cause the temperature to reach the weakening temperature of the sales line, or delivery line.

The oxygen removal vessels may be filled with any of the satisfactory oxygen removal material. It has been found in trials that iron sulfide can be employed on wood shavings as a constituent of the solid beds and effect removal of the oxygen at the low concentration. This is surprising in view of the prior art teachings that oxygen removal is not effective down to the low concentrations frequently necessary for sales. For example, it has been found helpful to use two foot diameter by four foot high beds filled with iron sponge having 15 pounds iron oxide per bushel. The high concentration of hydrogen sulfide then reacts the iron oxide to produce iron sulfide quickly and the iron sulfide in turn is regenerated by reaction with the oxygen contained in the gas. This reduces the oxygen concentration below the maximum concentration allowed by the sales contract and the respective series beds can be employed for prolonged intervals.

If desired, of course, the gas sales stream could be switched through alternative beds and suitable control monitors to monitor switching at a desired time interval or breakthrough of the oxygen. It is probable that continuous regeneration occurs where a reactive concentration of $H_2S$ exists.

It is believed helpful to consider some of the criteria which help make this process successful.

The iron sponge process is usually alpha iron oxide which is $Fe_2O_3$ with water and gamma $Fe_2O_3.H_2O$ is deposited on the wood shaving as absorbant for hydrogen sulfide. A stream of gas flows downward in a fixed bed of iron sponge and the hydrogen sulfide quickly reacts with the Ferric oxide to form Ferric sulfide in accordance with equation I:

$$Fe_2O_3+3H_2S \rightarrow Fe_2S_3+3H_2O \quad \text{(I)}$$

The oxidation, or regeneration, is in accordance with equation II:

$$2Fe_2S_3+3O_2 \rightarrow 2Fe_2O_3+65 \quad \text{(II)}$$

Theoretically 0.64 pounds $H_2S$ can be absorbed by 1 pound $Fe_2O_3$ or 0.60 pound or sulfur per pound of iron oxide. The prior art reported that 0.52 pounds of sulfur loading per pound of iron oxide was about 87 percent theoretical capacity at a first regeneration.

Each of the beds can be regenerated a plurality of times and reused. The iron sponge process can reduce $H_2S$ concentration to very low levels but on the gas employed initially in this test, a hydrogen sulfide concentration of about 200,000 part per million was employed so the reaction with hydrogen sulfide was much too rapid to be a commercial process for removal of hydrogen sulfide.

Activity and life of the beds depend upon the operating temperature and moisture content of the gas stream and iron oxide. It has been found that the optimum temperature range is about 60 degrees Fahrenheit to 120 degrees Fahrenheit, although oxygen removal can be accomplished at lower and higher temperatures. It is desirable to have the gas stream at, or near its water saturation point at the pressure and temperature existing at its entry into the first bed. The optimum moisture content of the iron sponge is about 30 to 50 percent by weight water. Material containing less than about 17 percent by weight water and more than 55 percent by weight water do not function properly removing hydrogen sulfide and consequently for removing oxygen by reaction with the hydrogen sulfide. The iron oxide can be dehydrated by operating at excessively high temperature with a corresponding loss of activity, and finally the formation of compounds which do not regenerate. This condition could require early replacement of the bed. In some installations the use of water sprays, indirect cooling by heat exchangers, and the like, may be required for optimum bed life or for safety in those installations where unexpected conditions could result in high inlet oxygen concentrations. Both the hydrogen sulfide reaction with the iron oxide and the oxygen removal reaction with the resulting iron sulfide are exothermic. The heat liberated by these reactions will cause a temperature increase in the iron sponge bed and the outlet gas stream. If the temperature is not controlled, at some point water will begin to vaporize from the bed, and it is possible to reach the kindling, or ignition temperature of the iron sponge bed if excessively high oxygen concentrations are allowed to enter the bed. In those cases where a continuous water addition is required, monitoring and control of the pH of water may be needed to maintain the alkaline condition of the iron sponge bed.

If desired, an oxygen analyzer may be employed upstream for safety shut down of the system before temperature increases intolerably. Also, an oxygen monitor can be employed downstream of the beds for verification of oxygen removal.

Several grades of iron sponge are on the market, with iron oxide contents up to 15 pounds per bushel, or approximately 15 pounds per cubic foot after loading into the bed. While any of these commercially available grades can be used, the 9 pound per bushel and the 15 pound per bushel grades of iron oxide appear to be the most economical for most applications. The higher iron oxide content will remove more oxygen before the bed must be changed, but will result in higher bed temperatures for any given inlet oxygen concentration.

When a sufficiently reactive concentration of hydrogen sulfide is present in the gas stream, almost all of the iron is maintained in the form of iron sulfide, with excess hydrogen sulfide passing out of the bed. Entering oxygen gas is being removed by reaction with iron sulfide, forming elemental sulfur and restoring the iron to the original form, iron oxide. This process continues until the deposition of solid sulfur physically blocks the surface of the iron sponge and the rate of reaction is slowed. This deactivation will progress slowly down through the bed until the oxygen content in the outlet gas exceeds the maximum allowable, at which time the gas stream must be diverted through another active bed while the deactivated bed is changed.

When a sufficiently reactive concentration of hydrogen sulfide is not present, this method may be accomplished by converting the iron sponge to the iron sulfide using hydrogen sulfide from another source. This method requires more residence time and results in a much lower quantity of oxygen removed. This bed may be used repeatedly in this manner until the physical deactivation by solid sulfur occurs and the bed must be changed.

Superficial velocities (based upon an empty vessel at the existing pressure and temperature) would normally be up to 10 feet per minute depending upon operating conditions. Pressure drops through an iron sponge bed used for oxygen removal can be calculated, using methods found in the literature, or obtained from the manufacturer of the iron sponge. The bed must be designed for sufficient velocity for good gas distribution, but excessive pressure drops which might cause bed compaction must be avoided. Bed depths in the range of 10 feet deep can normally be used, but lesser depths can be used in smaller vessels.

There are some other caveats. The iron sponge tends to loose its activity when it becomes coated with oil. Therefore, its application to rich gas should be carefully monitored to be sure that there is no oil carry over from respective separators. Any vessel employing the iron sulfide—iron oxide mixture on the wood shavings should be coated internally with epoxy resin or the like for corrosion control. Hydrate formation should be prevented. Hydrate formation is well documented, so control is relatively simple. A heavy duty strainer should be employed downstream of any iron sponge tower to prevent any carry over from the iron sponge or packings. Coarse packings are a good support for iron sponge. Two inch pipe cut into 2 to 3 inch long lengths can be used as bed support. They neither plug nor collapse. Specifically, a residence time of 1 to 5 minutes in the bed is necessary to insure that the oxygen contamination is reduced to a low contamination below about 8 part per million.

While iron oxide and iron sulfide on bed wood shavings are discussed more nearly completely herein, solid beds of carbon can be employed to remove the oxygen. In addition, the inventors believe that other materials like metallic sulfides, bauxite, (aluminum oxide $Al_2O_3$) and other sulfur catalysts may be feasible for this operation.

In operation as illustrated, a bed of material is installed in two vessels and they are connected into the sales stream as illustrated in the FIGURE. Thereafter the gas is collected. The gas may be collected through one-inch polyethylene line, or the thermoplastic line or pipe, since the pressure will be low enough. The smaller lines; for example, one-inch lines; then feed into a main collection manifold such as a two-inch line. The two-inch line then will feed into the suction line and into a separator where any liquids may be separated at the low pressure. Thereafter, the pressure is increased as indicated hereinbefore and a higher pressure separator is connected to store liquid products. The gas is then passed through the oxygen removal beds where oxygen is removed to comply with sales line specification.

Thereafter, the sales of natural gas with the oxygen below the predetermined maximum concentration is effected.

In the unlikely event that a high temperature is encountered, the shutdown motor valve 91 is closed by one or both the high temperature shutdown controllers 87, 89 interiorly of the respective beds 63 and 65. In the event there is a shutdown, the gas will then build up pressure and will be vented by back pressure relief valve 95 to the flare 97.

Frequently the sales line will demand an oxygen concentration below a maximum concentration of about 5 parts per million. This is exceptionally low and difficult to meet. This invention enables meeting this required low concentration of oxygen and is therefore unobvious in view of the prior art teachings that this process was only good for a much higher concentration.

Although this invention has been described with a degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A method of reducing the oxygen content of a natural gas stream below a predetermined maximum concentration initially with the range of 50–500 parts per million (ppm) comprising the steps of introducing the gas stream having the initial concentration in the range of 50–500 parts per million to a bed and passing the gas stream containing oxygen above said predetermined maximum concentration through a bed containing iron sulfide on a support in the presence of at least 17% by weight of water based on the weight of the iron sulfide and support at a velocity of between 2–10 feet per minute to give the natural gas stream a residence time of at least 1 minute and a temperature no greater than 120 degrees Fahrenheit such that oxygen concentration is reduced below said predetermined maximum concentration; and selling said natural gas stream after its oxygen content is reduced below said maximum concentration.

2. The method of claim 1 wherein said residence time is in the range of 1–5 minutes in said bed.

3. In a method of collecting low pressure gas below atmospheric pressure with a concentration of oxygen above a predetermined maximum concentration and in which the low pressure gas is compressed so that it forms a higher pressure gas, the improvement comprising:

a. introducing and passing the higher pressure gas with oxygen concentration with a concentration in the range of 50–500 ppm through a bed of a support containing iron oxide and iron sulfide for residence time in the range of 1–5 minutes; and b. injecting sufficient water to keep the moisture content sufficient for the reaction of the oxygen to occur; such that the oxygen concentration is reduced below the predetermined maximum concentration and the collected gas stream can be sold through a sales line.

4. The method of claim 3 wherein said bed containing the iron oxide and iron sulfide is regenerated and employed repeatedly.

5. The method of claim 3 wherein said bed contains both iron oxide and iron sulfide and wherein said gas contains both oxygen and hydrogen sulfide and there is a continuous and simultaneous reaction to convert the oxide to sulfide and hence remove the oxygen with the sulfide being converted back to the oxide which is in turn, converted to the sulfide on the bed and this happens continuously and repeatedly.

6. A method of reducing oxygen content of a natural gas stream below a predetermined maximum concentration in the range of 50–500 ppm comprising the steps of introducing and passing the gas stream containing oxygen above the predetermined maximum concentration through a bed containing an oxygen removal means comprising iron sulfide and iron oxide and wood filing in the presence of at least 17% by weight of water based on the weight of the iron sulfide and iron filing on wood at a velocity sufficient to remove the oxygen to below the maximum concentration allowed and, thereafter, selling a natural gas stream after its oxygen content is reduced below the maximum allowable concentration.

* * * * *